US008752312B2

(12) United States Patent
Vaz

(10) Patent No.: US 8,752,312 B2
(45) Date of Patent: Jun. 17, 2014

(54) CANVAS STRETCHING SYSTEM WITH CORNER CLAMPS

(76) Inventor: Paul Vaz, Carlsbad Springs (CA)

( * ) Notice: Subject to any disclaimer, the term of this patent is extended or adjusted under 35 U.S.C. 154(b) by 10 days.

(21) Appl. No.: 13/406,195

(22) Filed: Feb. 27, 2012

(65) Prior Publication Data

US 2012/0227293 A1 Sep. 13, 2012

Related U.S. Application Data

(63) Continuation of application No. 12/779,514, filed on May 13, 2010, now Pat. No. 8,122,624.

(51) Int. Cl.
*D06C 3/08* (2006.01)
*B05C 17/08* (2006.01)

(52) U.S. Cl.
USPC ..... 38/102.1; 38/102.91; 160/381; 101/127.1

(58) Field of Classification Search
USPC ..... 38/102–102.91; 160/378–381, 389; 101/127.1
See application file for complete search history.

(56) References Cited

U.S. PATENT DOCUMENTS

| | | | | | |
|---|---|---|---|---|---|
| 1,285,973 | A | * | 11/1918 | Fredman | 160/380 |
| 3,211,089 | A | | 10/1965 | Messerschmitt | |
| 3,422,554 | A | * | 1/1969 | Prinzhorn | 38/102.1 |
| 3,886,990 | A | * | 6/1975 | Campione | 160/374.1 |
| 4,161,977 | A | * | 7/1979 | Baslow | 160/381 |
| 4,161,997 | A | | 7/1979 | Norman | |
| 4,570,406 | A | | 2/1986 | DiFazio | |
| 4,769,934 | A | * | 9/1988 | Dolce | 40/789 |
| 4,860,467 | A | | 8/1989 | Larson | |
| 5,133,140 | A | * | 7/1992 | Frey | 38/102.91 |
| 5,136,797 | A | | 8/1992 | Hildebrandt | |
| 5,275,224 | A | | 1/1994 | Morris | |
| 5,450,701 | A | | 9/1995 | White | |
| 5,579,595 | A | | 12/1996 | Dutton | |
| 5,987,789 | A | * | 11/1999 | Lubina | 38/102.4 |
| 6,253,471 | B1 | | 7/2001 | Strauh | |
| 2006/0010729 | A1 | | 1/2006 | Liu | |
| 2007/0107355 | A1 | * | 5/2007 | Campbell | 52/515 |

OTHER PUBLICATIONS

Pertinent Pages of International Search Report From Corresponding Published PCT Application (International Publication No. WO 2009/062282 A1, International Application No. PCT/CA2007/002100), May 22, 2009 (2 pp).
Written Opinion From Corresponding PCT Application No. PCT/CA2007/002100, Aug. 13, 2008 (4pp).
Claims 1-6 reviewed by PCT for Written Opinion (provide as cite 2) from WO 2009/062282 (International Application No. PCT/CA2007/002100) (2pp.), Aug. 13, 2008.

* cited by examiner

*Primary Examiner* — Ismael Izaguirre
(74) *Attorney, Agent, or Firm* — The Eclipse Group LLP

(57) ABSTRACT

A stretching system to stretch a canvas or material on a frame without the use of stretching pliers and staples. Special purpose corner clamps are used to secure the stretcher bars into an initial open miter frame to orient the double sided adhesive strip on the side of the stretchers towards the canvas or material while maintaining the adhesive strip from touching the canvas or material. After alignment, the stretching bars are pressed down and attached onto the canvas or material and the corners are released. The corner clamps are removed and canvas or material corners are cut and folded into the open miter ends which also have adhesive strips. By rotating the stretchers axially 90 degrees into the final frame, thus closing the miters, and upon inserting U-shaped fasteners into the grooves placed on the back of the stretcher, the canvas or material is stretched and ready to display.

6 Claims, 9 Drawing Sheets

FIG 14 (a) (b)
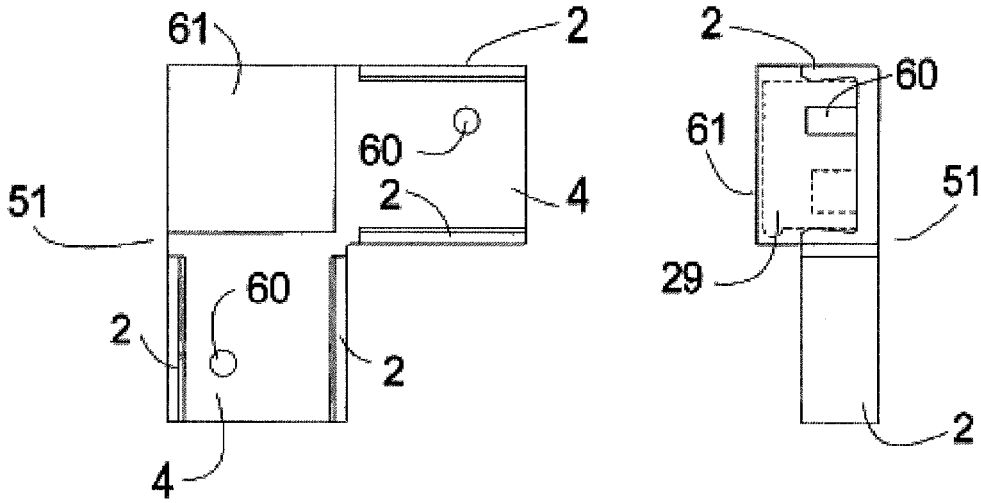
FIG 15
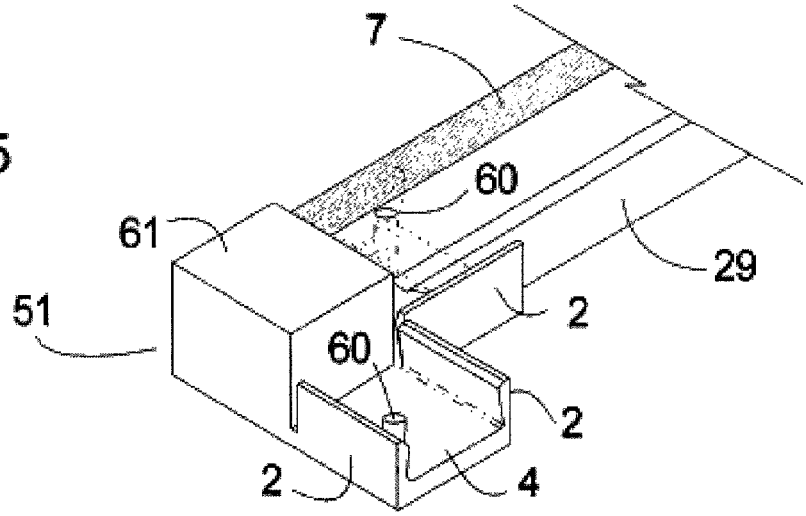

CANVAS STRETCHING SYSTEM WITH CORNER CLAMPS

RELATED APPLICATIONS

This application is a continuation of and claims priority to U.S. patent application Ser. No. 12/779,514 filed May 13, 2010 titled CANVAS STRETCHING SYSTEM WITH CORNER CLAMPS and claims the benefit of International Application No. PCT/CA2007/002100, filed 13 Nov. 2007, titled "CANVAS STRETCHING SYSTEM WITH CORNER CLAMPS," the entirety of both applications are incorporated by reference into this application.

BACKGROUND OF THE INVENTION

1. Field of Invention

This invention relates to frames that are used to mount and to provide tension for flexible fabrics, such as artists canvasses, silk screen, digital photographs, and the like. In particular this invention relates to special purpose corner clamps that allow for the use of adhesive to attach the canvas to the stretcher bars.

2. Description of the Related Art

Most prior art stretchers are manufactured as standard dimension lengths with machined ends. These lengths are assembled into frames with interlocking corners. The canvas or material is stretched on this frame using stretching pliers and with staples on the side. Wedges can be inserted into the interlocking corners to expand the frame and tension the canvas. Stretcher bars of this type have a few disadvantages:

When first assembled the stretcher bars must be squared and aligned by the user or the diagonals will be off, making subsequent framing difficult or impossible.

The stretching of the material on the stretcher bars requires the use of specific tools like stretching pliers and staple guns, both of which are costly and might not be available in the average consumer's household.

When stretching the material with pliers it is very difficult to apply an even tension along every side of the material and this can cause undue stress on the stretcher bars, quite often causing the frame to warp and the material to wrinkle.

This stretching system requires a fair amount of skill, strength and practice in order to get good results. Thus it is intimidating and not user friendly.

In this type of stretching system, the staples are normally placed on the side of the stretcher bars which makes the side edges of the material unsightly.

The corners of the material must be folded and fastened on the sides, adding bulk and detracting further from the neat edge appearance of the finished product.

The sophisticated nature of the machined ends of the stretcher bars do not allow for resizing and therefore cannot be used if the dimensions of the material to be stretched does not fall within the standard sizes currently being manufactured.

Currently available stretcher bars allow for expansion with the use of wedge inserts into the interlocking corners. These inserts, however, are often missing from the corners making it impossible to retighten the corners without them.

A lot of material is wasted due to the fact that the stretching pliers need extra material around the frame to grab onto.

It is an object of the present invention to overcome the disadvantages described and provide a canvas stretching system which can be easily used by the novice framer.

SUMMARY OF THE INVENTION

According to one embodiment of the invention there is provided a modular canvas or material framing system comprising (a) four stretcher bars mitered at the ends to be assembled into a rectangular frame for supporting a canvas or material, each stretcher bar having a groove or ridge running lengthwise in the bar at the inner side of the bar so as to face inwardly in the assembled frame and a groove on the outer face of the stretcher running perpendicular to the adhesive strip close to the miter ends so as to face outwardly in the assembled frame, each stretcher bar having an adhesive strip running lengthwise in the bar at the outer side of the bar so as to face outwardly in the assembled frame and extended to cover the mitered ends of the stretchers; (b) a set of U shaped fasteners applied to grooves supplied on the stretcher to keep the stretching frame in the closed position and to counter act the tension to the canvas upon closing the frame; (c) a stretching bar holding device consisting of two clamps at right angles that hold the stretcher bar ends securely in an open miter position, each having a raised platform to keep the stretchers from touching the canvas or material so that alignment can take place; (d) a set of brace members sized to engage with the grooves or ridges of the stretcher bars to reinforce the finished canvas or material frame.

Preferably corner clamps are used to assemble the stretcher bars in an initial open miter position in such a way that they are secure, square and properly placed relative to each other. The corner clamps keep the exposed adhesive on the stretchers from touching the canvas or material before pressing down to allow for easy alignment of the open miter frame. The corner clamps release the stretcher bars by pushing towards the canvas or material when proper alignment is achieved.

The canvas or material corners are cut and adhered to the open miter which contains an adhesive strip before the stretching frame is closed thus avoiding unsightly corner folds. A U shaped fastener is inserted into a groove on the stretcher bar to counter act the tension to the canvas or material and to keep the stretching frame closed.

BRIEF DESCRIPTION OF THE DRAWINGS

Embodiments of the invention will now be described with reference to the following drawings in which:

FIG. 1(*b*) is a right side view of the locking corner clamp used for holding the stretcher bars square and secure in the open miter position according to one embodiment of the present invention.

FIG. 1(*c*) is a bottom side view of the locking corner clamp used for holding the stretcher bars square and secure in the open miter position according to one embodiment of the present invention.

FIG. 2 (*b*) is a top view of a typical stretcher bar.

FIG. 2 (*c*) is a front view of a typical stretcher bar.

FIG. 2 (*d*) is a bottom view of a typical stretcher bar.

FIG. 2 (*e*) is a side view of a typical stretcher bar.

FIG. 4(*b*) is a front side view of the assembled stretcher bars in the open miter position using the locking corner clamps. The adhesive strips are exposed and ready to adhere to the canvas or material.

FIG. 10(*b*) is a right side view of the finished stretched canvas with all corner braces and locking fasteners inserted.

FIG. 10(*c*) is a back view of the finished stretched canvas with all corner braces and locking fasteners inserted.

FIG. 11 (*b*) is a front view of the spacer block used to allow different width of stretchers to be used with the same locking clamp.

FIG. 11 (*c*) is a right side view of the spacer block used to allow different width of stretchers to be used with the same locking clamp.

FIG. 12(*b*) is a side view of the corner clamp with the spacer blanks inserted for the medium width stretcher bar inserted.

FIG. 13(*b*) is a front view of the corner clamp with the spacer blocks inserted for the narrow width stretcher bar inserted.

FIG. 14(*a*) shows a top view of an alternate corner clamp configuration with single corner raised platform and showing the stopping means.

FIG. 14(*b*) shows a right side view of an alternate corner clamp configuration with a single corner raised platform and showing the stopping means such as a tab or peg which is used to fit into a corresponding hole or slot on the stretcher bar to ensure the stretcher bar mitre end is located properly against the mitre platform.

FIG. 15 shows a perspective view of an alternate corner clamp with a single raised mitre platform and showing the stopping means such as a tab or peg which is used to fit into a corresponding hole or slot on the stretcher bar to ensure the stretcher bar mitre end is located properly against the mitre platform.

FIG. 16(*b*) shows a side view of an alternate corner clamp configuration for thin stretcher bars where the spring tabs and the mitre stop are used to maintain the adhesive strip on the stretcher bars from touching the canvas or material before pressing down.

DESCRIPTION OF THE PREFERRED EMBODIMENT

Figure 1:
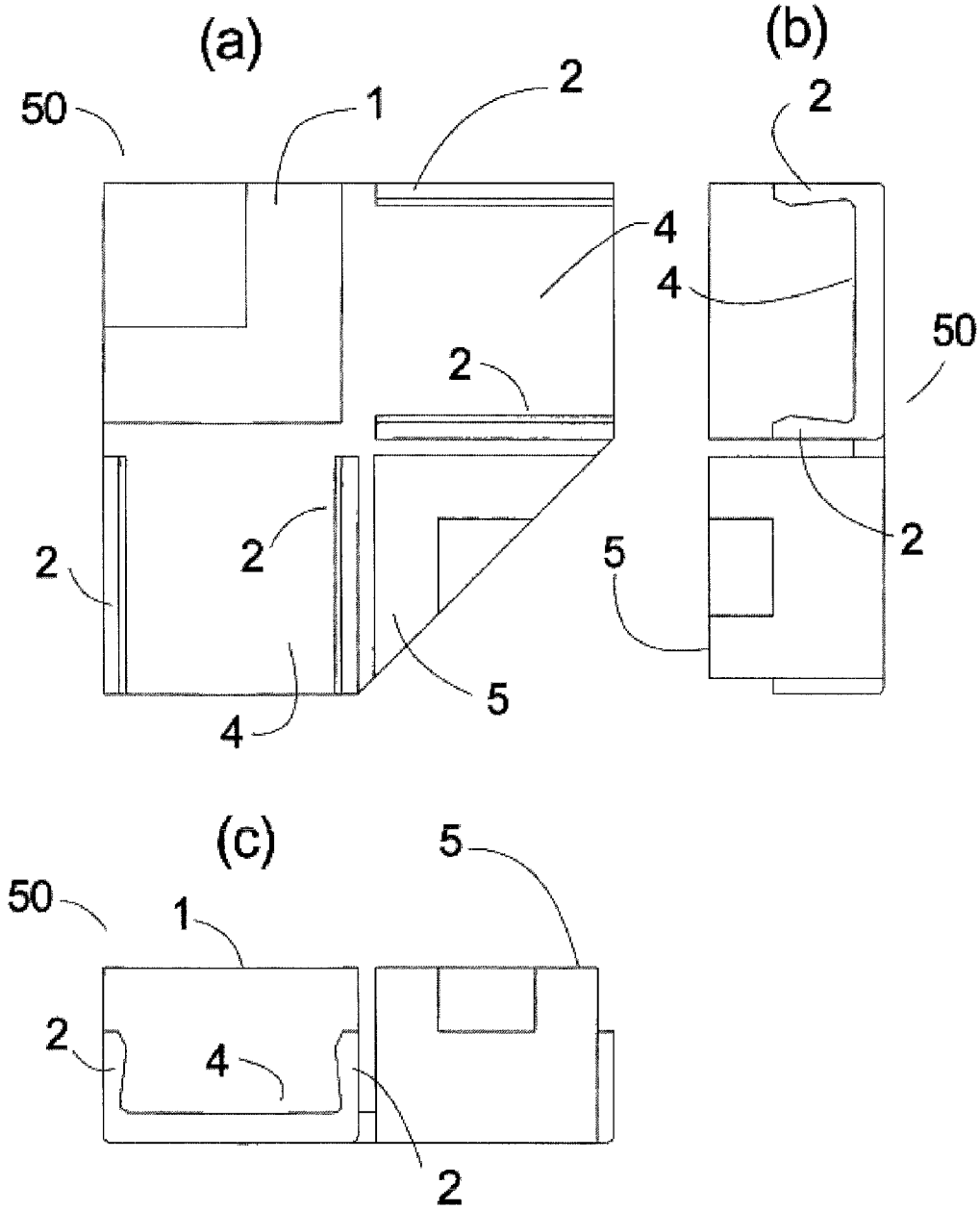
FIG. 1(*a*) is a top view of the locking corner clamp used for holding the stretcher bars square and secure in the open miter position according to one embodiment of the present invention.

This invention relates to a canvas stretching system which uses locking corner clamps 50 and four stretcher bars 25 to form a generally square or rectangular stretcher frame 70. In the first operation, the canvas 20 to be stretched is placed on a flat surface, such as a table (not shown), with the image (such as a painting, silk screen, digital photograph, and the like) facing downwards. The corner clamps 50 are placed with cavity 4 facing up. The four stretcher bars 25 are inserted into the respective cavities 4 of the corner clamps 50 in an initial open miter position in such a way that they are square and properly placed relative to each other to form the stretcher frame 70. Each stretcher bar 25 has an adhesive strip 7 which faces the material 20 to be stretched. The corner clamps 50 are also designed to keep the stretcher frame 70 from touching the canvas 20 when mounting thus allowing for easy alignment. When the stretcher frame 70 is in the right position over the canvas 20 the stretcher bars 25 are pressed down and the adhesive strip 7 on the stretcher bars 25 comes into contact with the canvas 20. The locking corner clamps 50 are removed and the corners 17 of the canvas or material 20 are cut and adhered to the adhesive strip 10 on the exposed miters. The stretchers bars 25 are rotated along their longitudinal axis into their final position. The rotation of the stretcher bars 25 and the interference of the material inside the miters will stretch the canvas 20 resulting in a very uniform tension along every side of the stretching frame 70. A U-shaped fastener 13, such as a staple, is inserted into grooves 12 on the stretcher bars 25 and is used to counteract the tension of the canvas 20 in order to keep the stretcher frame 70 closed.

Braces 40 can be inserted into the groove 15 on the inside face opposite to the outer edges of the stretching frame 70 to add stiffness and alignment to the final product. These braces 40 can be further used to increase the tension of the canvas or material 20 by being drawn towards the corners to which they are affixed.

FIG. 1 shows a top view of the corner clamp 50. The raised mitre stop 1 is used in the corner clamp 50 as a register stop for ends of the stretcher bar 25 (FIG. 3) to ensure that the open miter ends 6 are positioned correctly relative to each other. The tabs 2 utilize the resiliency of the material 50 (FIG. 4) to clamp the stretcher bars 25 (FIG. 3) and hold them securely in place. The cavity 4 between the tabs 2 must be slightly narrower than the width of the stretcher bar 25 in order for the tabs 2 to deflect properly and clamp the stretcher bars 25 securely. The raised stabilizing platform 5 is used along with raised mitre stop 1 to keep the adhesive strip 7 (FIGS. 2 & 3) from touching the canvas 20 and to keep the corner clamp 50 from twisting when it is pressed down.

Figure 2:
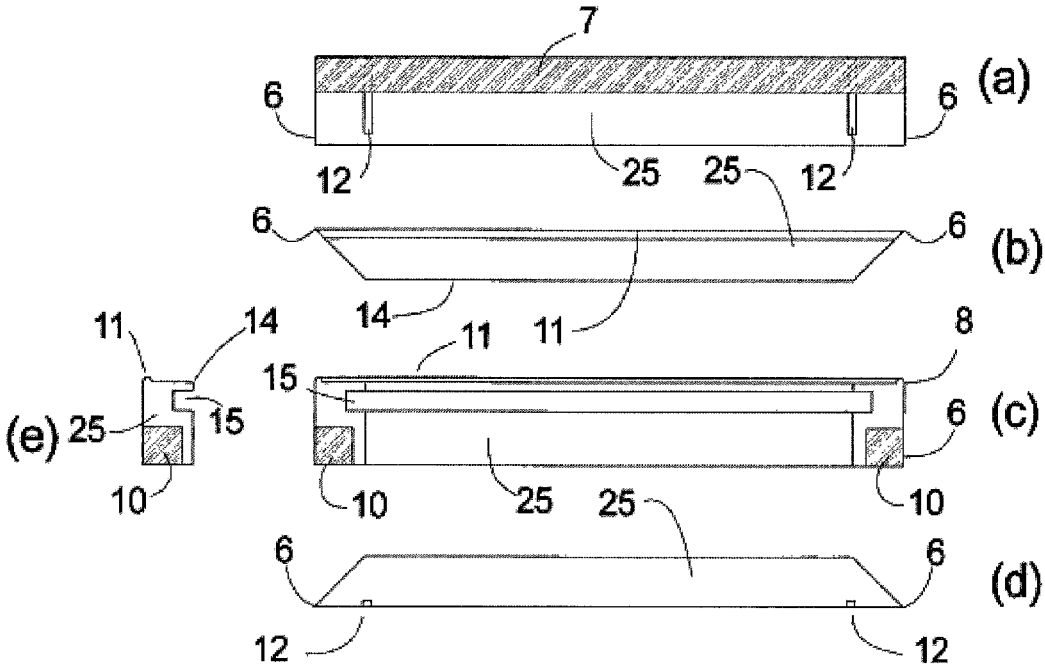
FIG. 2 (*a*) is a back view of a typical stretcher bar.

FIG. 2 shows a side view of a typical stretcher bar 25. An adhesive strip 7 is applied to the stretcher bars 25 on the side that is to be adhered to the canvas or material 20 (FIG. 3), which will be the outer perimeter of the closed stretching frame 70 formed by the four stretcher bars 25. The adhesive strip 7 also wraps around the open miters 10 of the stretcher bars 25. The typical stretcher bar 25 will have a groove 15 on its' inside face to accept a brace 40 to secure and strengthen the finished stretching frame 70. A bead 11 on the top of the stretcher bar 25 will keep the canvas 20 away from the inside edge 14 of the stretcher bars 25 to prevent a crease on the image of the finished stretcher frame 70. Grooves 12 are provided to insert the "U" shaped closing fasteners 13 on the back of the stretching frame 70.

Figure 3:
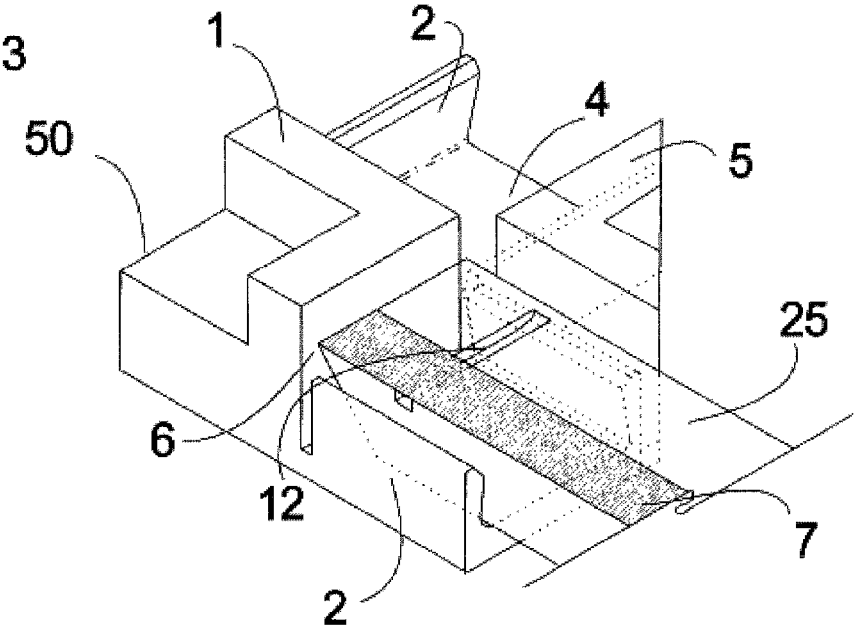
FIG. 3 is a perspective view of a locking corner clamp showing one stretcher bar inserted.

FIG. 3 shows a perspective view of the corner clamp 50 with the stretcher bar 25 inserted in the cavity 4 on one side. The end of the miter 6 of the stretcher bar 25 is pushed against the raised mitre stop 1 for correct positioning. The raised mitre stop 1 must be higher than the back of the stretcher bar 25 to keep the adhesive strip 7 from touching the back of the canvas 20 for easy alignment. Tabs 2 hold the stretcher bar 25 securely in place.

Figure 4:
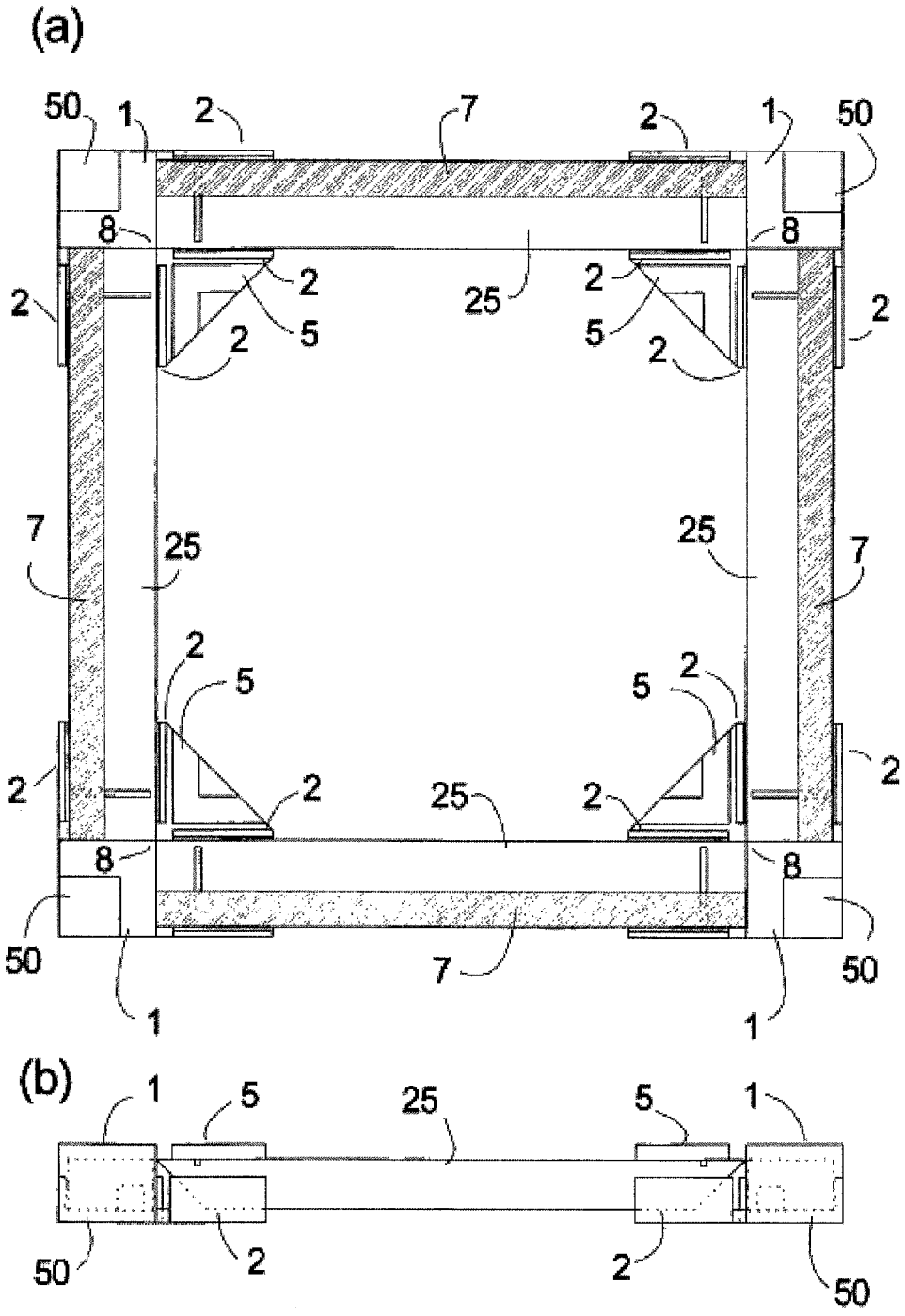
FIG. 4(*a*) is a top view of the assembled stretcher bars in the open miter position using the locking corner clamps. The adhesive strips are exposed and ready to adhere to the canvas or material (not shown).

FIG. 4 shows the stretcher bars 25 held in the open miter position by the corner clamps 50. The corners 8 of the stretcher bars 25 must meet in order to achieve proper tension of the canvas 20. The adhesive strips 7 are exposed and ready to fasten to the canvas 20.

Figure 5:
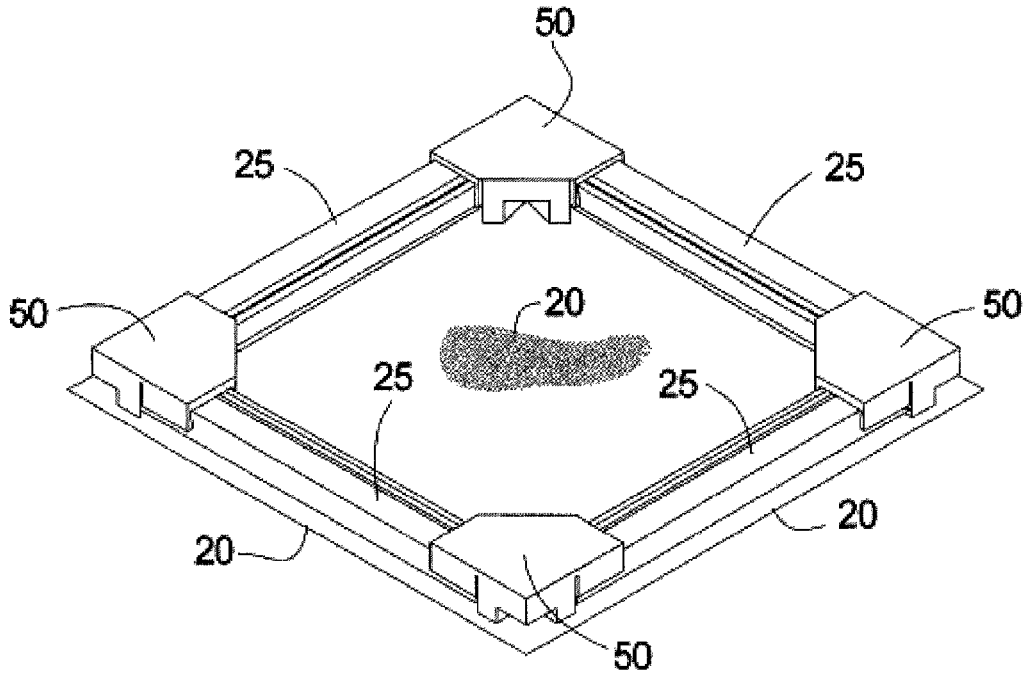
FIG. 5 is a perspective view of the stretcher bars in the open miter position placed over the canvas or material which is placed face down and ready to adhere to the adhesive strips on the stretcher.

FIG. 5 shows the stretcher bars 25 in place and aligned over the back of the canvas 20.

Figure 6:
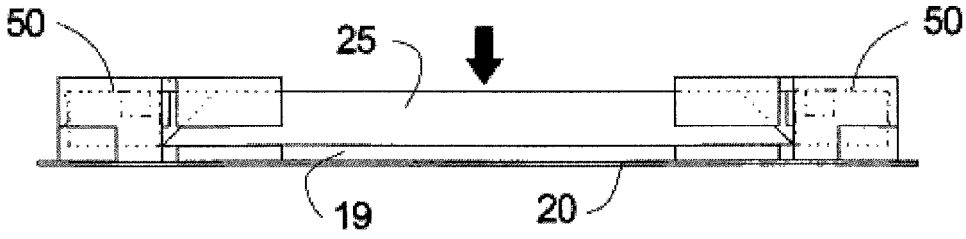
FIG. 6 is a side view of the stretcher bars in the open miter position placed over the canvas or material, showing the spacing between the stretchers and the canvas so the alignment can take place before the adhesive comes into contact.

FIG. 6 shows the space 19 between the stretcher bars 25 and the canvas 20. A downward push on the stretcher bars 25 will adhere them to the canvas 20 by means of the adhesive strip 7.

Figure 7:
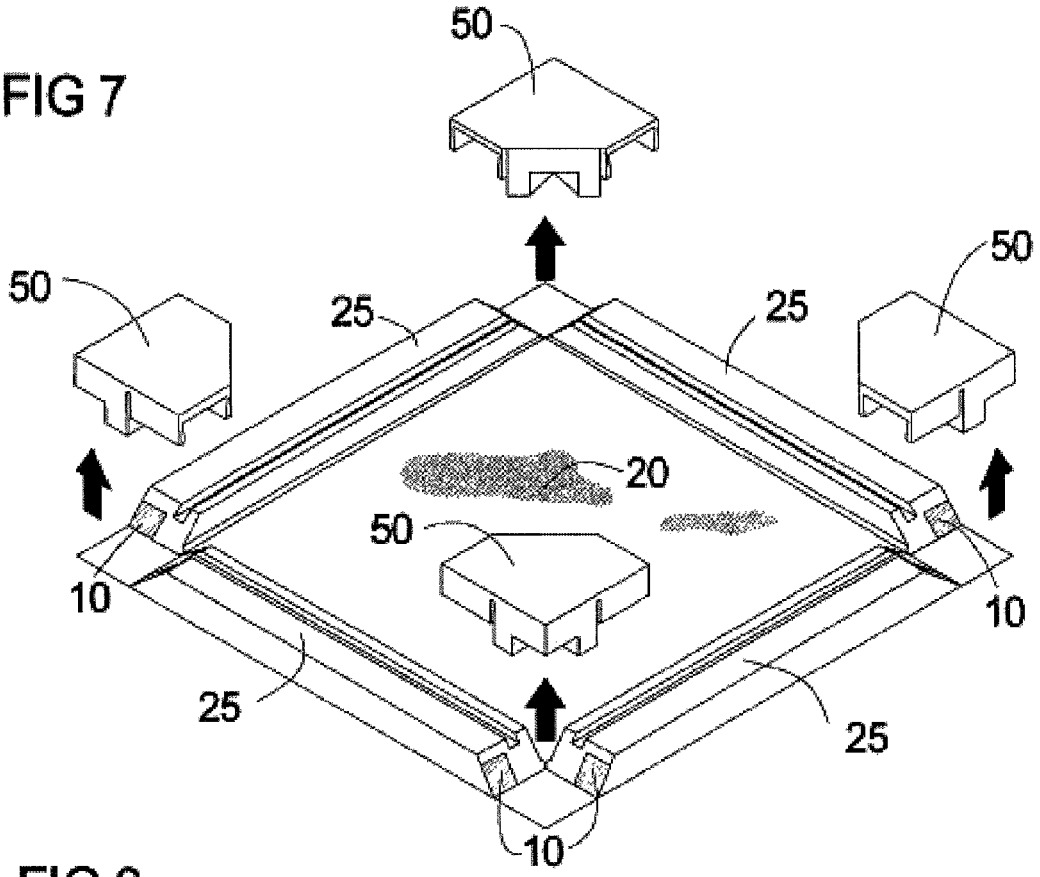
FIG. 7 is a perspective view of the stretcher frame in the open miter position adhered to the canvas and the locking corner clamps removed.

FIG. 7 shows the stretcher bars 25 adhered to the back of the canvas 20 with the corner clamps 50 removed, exposing the adhesive strips 10 on the open miters.

Figure 8:
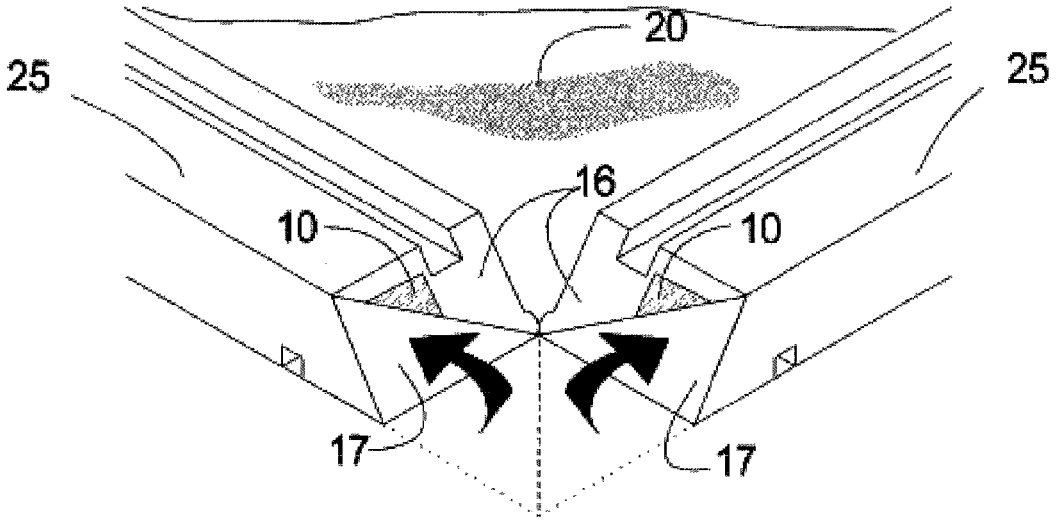
FIG. 8 is a perspective view of the folding and adhering of the canvas corners onto the open miters of the stretching frame.

FIG. 8 shows the corners 17 of the canvas 20 cut folded and adhered onto adhesive strips 10 on the open miter ends 16.

Figure 9:
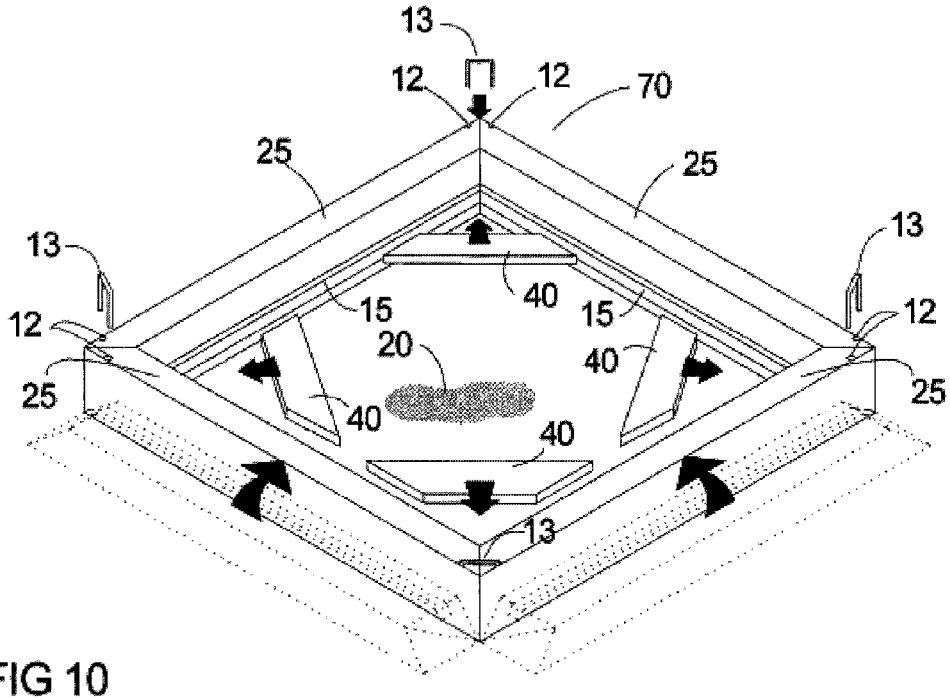
FIG. 9 is a perspective view of the top of the stretching frame now rotated into the final (miter closed) position. Also shown is the insertion of the locking fastener and a corner brace.

In FIG. 9 the stretcher frame 70 has been rotated into the (closed miter) final position. The U-shaped closing fasteners 13 are inserted into the fastener grooves 12 of the stretcher bars 25 to keep the frame 70 in the closed position. The corner braces 40 are inserted into the inner grooves 15 of stretcher bar 25 to add stiffness and allow for increased tension of the canvas 20.

Figure 10:
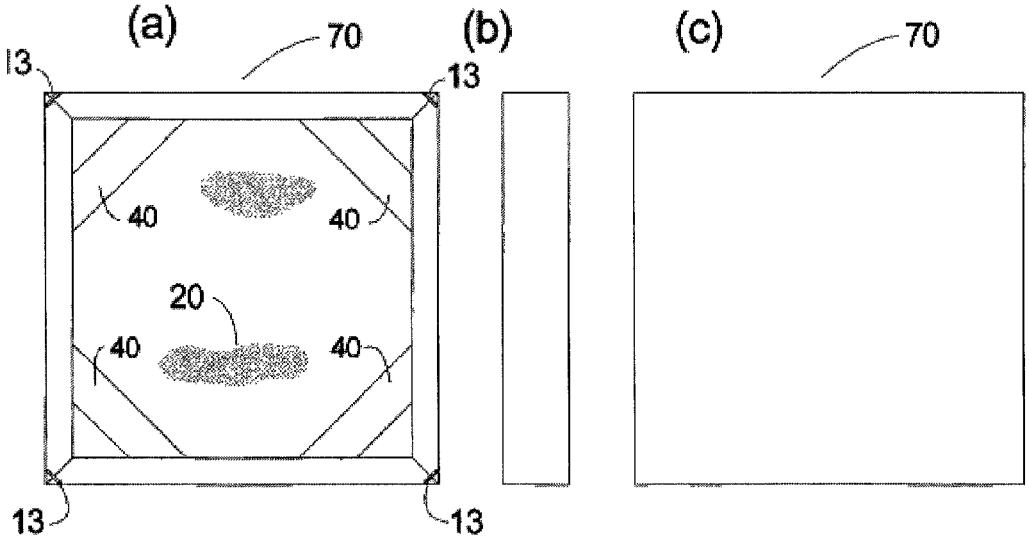
FIG. 10(*a*) is a top view of the finished stretched canvas with all corner braces and locking fasteners inserted.

FIG. 10 shows a top view of the finished stretcher frame 70 with the corner braces 40 inserted.

Figure 11:
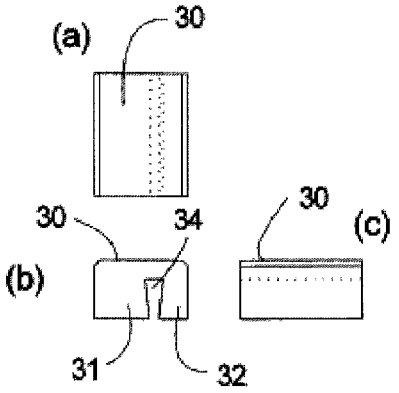
FIG. 11 (*a*) is a top view of the spacer block used to allow different width of stretchers to be used with the same locking clamp.

FIG. 11 shows a spacer block 30 used to allow different width of stretcher bars 25 to be used with the same locking corner clamp 50. Spacer block 30 has a groove 34 which is dovetail shaped and slides over tab 2 of the corner clamp 50. The spacer block 30 has two sides of different thicknesses. Side 31 is used for narrow width stretcher bars 27 and side 32 is used for medium width stretcher bars 26.

Figure 12:
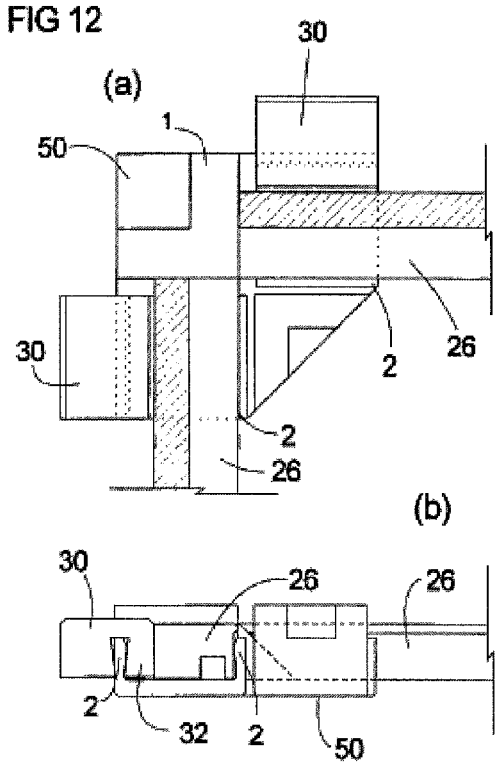
FIG. 12(*a*) is a top side view of the corner clamp with the spacer blocks inserted for the medium width stretcher bar inserted.

FIG. 12 shows a top and side view of the corner clamp 50 with spacer blocks 30 inserted for the medium width stretcher bar 26. The spacer block 30 slides onto tab 2 with side 32 facing the back of medium width stretcher bar 26 in such a way that this width of stretcher bar 26 is held securely.

Figure 13:
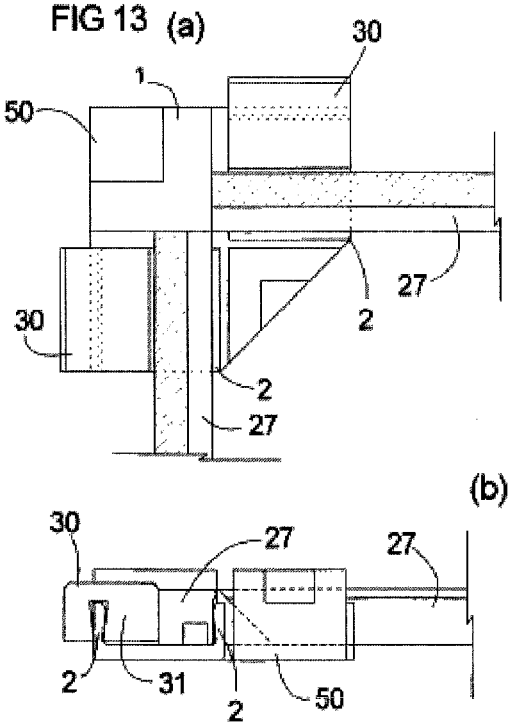
FIG. 13(*a*) is a top view of the corner clamp with the spacer blocks inserted for the narrow width stretcher bar inserted.

FIG. 13 shows a top and side view of the corner clamp 50 with spacer blocks 30 inserted for the narrow width stretcher bar 27. The spacer block 30 slides onto tab 2 with side 31 facing the back of stretcher bar 27 in such a way that this width of stretcher bar 27 is held securely.

FIG. 14 *a* and FIG. 14*b* shows a top and side view of an alternate corner clamp configuration 51 with a single raised mitre platform 61. A tab or peg 60 is used to fit into a corresponding hole or slot on the stretcher bar 29 to ensure that the end of the mitre on the stretcher bar 29 is located properly against the mitre platform 61.

FIG. 15 shows a perspective view of an alternative corner clamp configuration 51 with a single raised mitre platform 61. A tab or peg 60 is used to fit into a corresponding hole or slot on the stretcher bar 29 to ensure that the end of the mitre on the stretcher bar 29 is located properly against the mitre platform 61.

Figure 16:
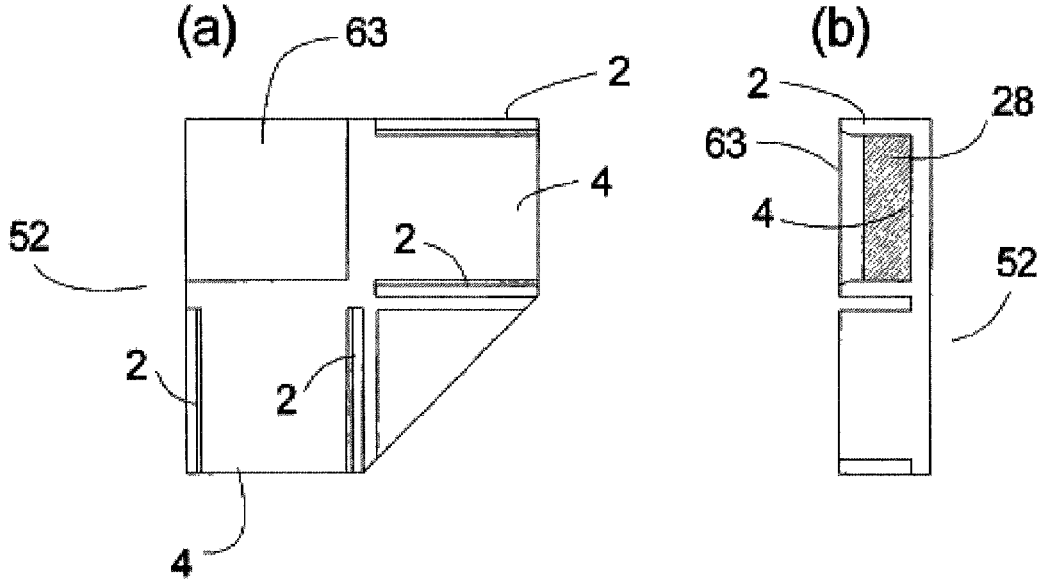
FIG. 16(*a*) shows a top view of an alternate corner clamp for thin stretcher bars where the spring tabs along with the mitre stop are used to maintain the adhesive strip on the stretcher bars from touching the canvas or material before pressing down.

FIG. 16 *a* and FIG. *b* shows a top and side view of an alternate corner clamp 52 for thin stretcher bars 28. In this configuration the adhesive strip 7 on the stretcher bar 28 falls below the tops of the spring tabs 2 and the raised mitre stop 63 to keep the stretcher bar 28 from touching the canvas 20 when mounting, and therefore a raised mitre stop is not necessary.

Figure 17:
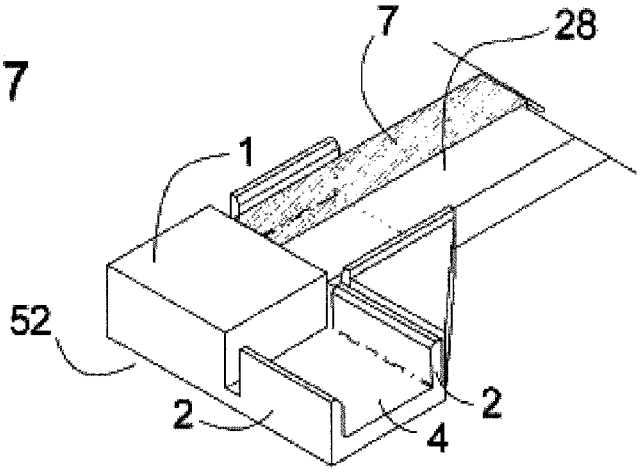
FIG. 17 shows a perspective view of an alternate corner clamp for thin stretcher bars where the spring tabs and mitre stop are used to maintain the adhesive strip on the stretcher bars from touching the canvas or material before pressing down.

FIG. 17 shows a perspective view of an alternate corner clamp 52 for thin stretcher bars 28. In this configuration the adhesive strip 7 on the stretcher bar 28 falls below the tops of the spring tabs 2 and the raised mitre stop 1 to keep the stretcher bar 28 from touching the canvas 20 when mounting, and therefore a raised mitre stop is not necessary.

The invention claimed is:

1. A stretcher bar for use with a modular canvas or material framing system, said stretcher bar having miter ends and a groove or ridge running lengthwise in the bar at the inner side of the bar so as to face inwardly in the assembled frame, said stretcher bar having an adhesive strip running lengthwise in the bar at the outer side of the bar so as to face outwardly in the assembled frame and extended to cover the miter ends of the stretcher bar and a groove on the outer face of the stretcher running perpendicular to the adhesive strip close to the miter ends so as to face outwardly in the assembled frame.

2. A stretching system for use with a modular canvas or material framing system, the stretching system comprising:

a stretcher bar, said stretcher bar having miter ends and a groove or ridge running lengthwise in the bar at the inner side of the bar so as to face inwardly in the assembled frame, said stretcher bar having an adhesive strip running lengthwise in the bar at the outer side of the bar so as to face outwardly in the assembled frame and extended to cover the miter ends of the stretcher bar and a groove on the outer face of the stretcher bar running perpendicular to the adhesive strip close to the miter ends so as to face outwardly in the assembled frame; and two clamps at right angles that hold the ends of the stretcher bar securely in an open miter position, each clamp having a raised platform to keep the stretcher bars from touching the canvas or material so that alignment can take place.

3. A stretching system for use with a modular canvas or material framing system, the stretching system comprising:

a stretcher bar, said stretcher bar having miter ends and a groove or ridge running lengthwise in the bar at the inner side of the bar so as to face inwardly in the assembled frame, said stretcher bar having an adhesive strip running lengthwise in the bar at the outer side of the bar so as to face outwardly in the assembled frame and extended to cover the miter ends of the stretcher bar and a groove on the outer face of the stretcher bar running perpendicular to the adhesive strip close to the miter ends so as to face outwardly in the assembled frame; and corner clamps wherein said corner clamps are used to assemble the stretcher bars in an initial open miter position in such a way that they are secure, square and properly placed relative to each other.

4. The stretching system of claim 3 wherein said corner clamps keep the exposed adhesive on the stretcher bars from touching the canvas or material before pressing down to allow for easy alignment of the open miter frame.

5. The stretching system of claim 4 wherein the corner clamps release the stretcher bars by pushing towards the canvas or material when proper alignment is achieved.

6. The stretching system of claim 3 wherein the corner clamps release the stretcher bars by pushing towards the canvas or material when proper alignment is achieved.

* * * * *